US006547254B2

(12) United States Patent
Ito et al.

(10) Patent No.: US 6,547,254 B2
(45) Date of Patent: Apr. 15, 2003

(54) SEAL STRUCTURE BETWEEN CYLINDER HEAD AND HEAD COVER IN ENGINE

(75) Inventors: Keita Ito, Wako (JP); Takao Nishida, Wako (JP); Tetsuya Arai, Wako (JP); Shigeki Edamatsu, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/898,447

(22) Filed: Jul. 5, 2001

(65) Prior Publication Data

US 2002/0024184 A1 Feb. 28, 2002

(30) Foreign Application Priority Data

Jul. 11, 2000 (JP) ..... 2000-215851

(51) Int. Cl.[7] ..... F02F 11/00

(52) U.S. Cl. ..... 277/600; 277/641; 277/642; 277/910; 123/195 C; 123/198 E

(58) Field of Search ..... 277/598, 637, 277/641, 642, 910, 600; 123/195 C, 198 E

(56) References Cited

U.S. PATENT DOCUMENTS 2,404,409 A * 7/1946 Smith
2,459,668 A * 1/1949 Melichar
3,430,799 A * 3/1969 Maier
3,678,914 A * 7/1972 Vulliamy ..... 123/195 C
3,936,059 A * 2/1976 Gordon
4,027,644 A * 6/1977 Timour ..... 123/198 E
4,117,823 A * 10/1978 Funabashi et al. ..... 123/198 E
4,192,520 A * 3/1980 Hasegawa
4,501,432 A * 2/1985 Kuniyoshi et al.
4,508,072 A * 4/1985 Takami et al. ..... 123/195 C
4,607,604 A * 8/1986 Kanoh et al. ..... 123/572
4,739,735 A * 4/1988 Ichida et al. ..... 123/90.23
4,930,469 A * 6/1990 Kamprath et al. ..... 123/195 C
5,070,829 A * 12/1991 Guntly et al. ..... 123/179.9
5,096,208 A * 3/1992 Westberg
5,285,754 A * 2/1994 Bell ..... 123/90.38
5,311,847 A * 5/1994 Boehning ..... 123/90.38
5,367,993 A * 11/1994 Tulach et al. ..... 123/90.38
5,375,569 A * 12/1994 Santella ..... 123/90.38
5,511,518 A * 4/1996 Jain et al. ..... 123/90.37
5,983,852 A * 11/1999 Weitz et al. ..... 123/198 E
6,302,074 B1 * 10/2001 Bolsover et al. ..... 123/90.38

* cited by examiner

*Primary Examiner*—Anthony Knight
*Assistant Examiner*—Alison K. Pickard
(74) *Attorney, Agent, or Firm*—Armstrong, Westerman & Hattori, LLP

(57) ABSTRACT

A seal structure in an engine, including a seal member interposed between a cylinder head having a slanting face portion at least at an intermediate portion of its upper end face to which a valve-operating cam chamber opens, and a head cover coupled to the upper end face of the cylinder head by a bolt to close the valve-operating cam chamber. The head cover has a fit wall portion formed thereon and fitted to an inner peripheral surface of the valve-operating cam chamber, and the seal member is mounted in a seal groove provided in an outer peripheral surface of the fit wall portion to come into close contact with an inner peripheral surface of the cylinder head. Thus, an interference can be provided equally at various portions of the seal member irrespective of the number of bolts used, and the seal member can always exhibit a good seal function.

1 Claim, 16 Drawing Sheets

12
5
71
53
E
34
74
31
29
33
27'
35
27
24
25
26
30
28
21
8
1
22
23
10
37
9
38
60
36
40
18
8a
19
7
15
56
7a
6
84
56a
17
40a
6L
5
16
6R
43
57
17'
41
14
14'
55
6a
39
O
64
13
39'
32
63
6
86
56b
62
61
65
12
12
6

71
74
80
21
8
73
75
76

SEAL STRUCTURE BETWEEN CYLINDER HEAD AND HEAD COVER IN ENGINE

BACKGROUND OF THE INVENTION

1. Field of the Invention

The present invention relates to a seal structure between a cylinder head and a head cover in an engine, including a seal member interposed between the cylinder head and the head cover, the cylinder head having a slant at least at an intermediate portion of its upper end face to which a valve-operating cam chamber opens, the head cover being coupled the upper end face of the cylinder head by a bolt to close the valve-operating cam chamber.

2. Description of the Related Art

In a conventional engine, joint surfaces of a cylinder head and a head cover are formed in one plane, and a seal member such as an O-ring, a gasket or the like, is interposed between the joint surfaces to provide the sealing between the cylinder head and the head cover. In such a seal structure, it is necessary for ensuring a normal seal function to couple the cylinder head and the head cover to each other by a large number of parallel bolts, to equalize the interference of the seal member at various portions.

If the upper end face of the cylinder head is formed according to the shape of a mechanism within a valve-operating chamber in order to make the engine more compact, the upper end face may be a three-dimensional face having a slant at its intermediate portion. In such a case, it is difficult to equalize the interference of the seal member at various portions, even if a large number of parallel bolts are used as in the prior art. Moreover, the use of the large number of bolts does not permit a reduction in cost.

SUMMARY OF THE INVENTION

Accordingly, it is an object of the present invention to provide a seal structure between the cylinder head and the head cover in the engine, wherein an interference uniform at the various portions of the seal member can be provided irrespective of the number of bolts used, and the seal member can always exhibit a good seal function.

To achieve the above object, according to a first aspect and feature of the present invention, there is provided a seal structure between a cylinder head and a head cover in an engine, comprising a seal member interposed between said cylinder head and said head cover, said cylinder head having a slant at least at an intermediate portion of an upper end face of the cylinder head to which face a valve-operating cam chamber opens, said bead cover being coupled to the upper end face of said cylinder head by a bolt to close said valve-operating cam chamber, wherein the head cover has a fit wall portion formed thereon and fitted to an inner peripheral surface of the valve-operating cam chamber, and the seal member is mounted in a seal groove provided in an outer peripheral surface of the fit wall portion to come into close contact with an inner peripheral surface of the cylinder head.

With the above arrangement, an interference uniform at the various portions of the seal member can be provided irrespective of the number of bolts used and an axial force, thereby ensuring a good sealed state between the cylinder head and the head cover. Moreover, bolts for securing a flange portion of the head cover to the cylinder head do not affect in the interference of the seal member and merely performs the securing of the head cover to the cylinder head.

Therefore, it is possible to reduce the number of the bolts required, thereby reducing the cost.

According to a second aspect and feature of the present invention, in addition to the first feature, the upper end face of the cylinder head comprises a pair of flat face portions which are parallel to each other at different height levels, and a slant connecting the flat face portions to each other, and the head cover is formed with a flange portion abutting against the upper end face, the flange portion being coupled to the cylinder head at locations corresponding to the flat face portions by bolts.

With the above arrangement, the head cover can be secured simply and reliably by a small number of bolts.

The above and other objects, features and advantages of the invention will become apparent from the following description of the preferred embodiment taken in conjunction with the accompanying drawings.

DESCRIPTION OF THE PREFERRED EXEMPLARY EMBODIMENT

The present invention will now be described by way of preferred exemplary embodiment shown in the accompanying drawings.

Figure 1:
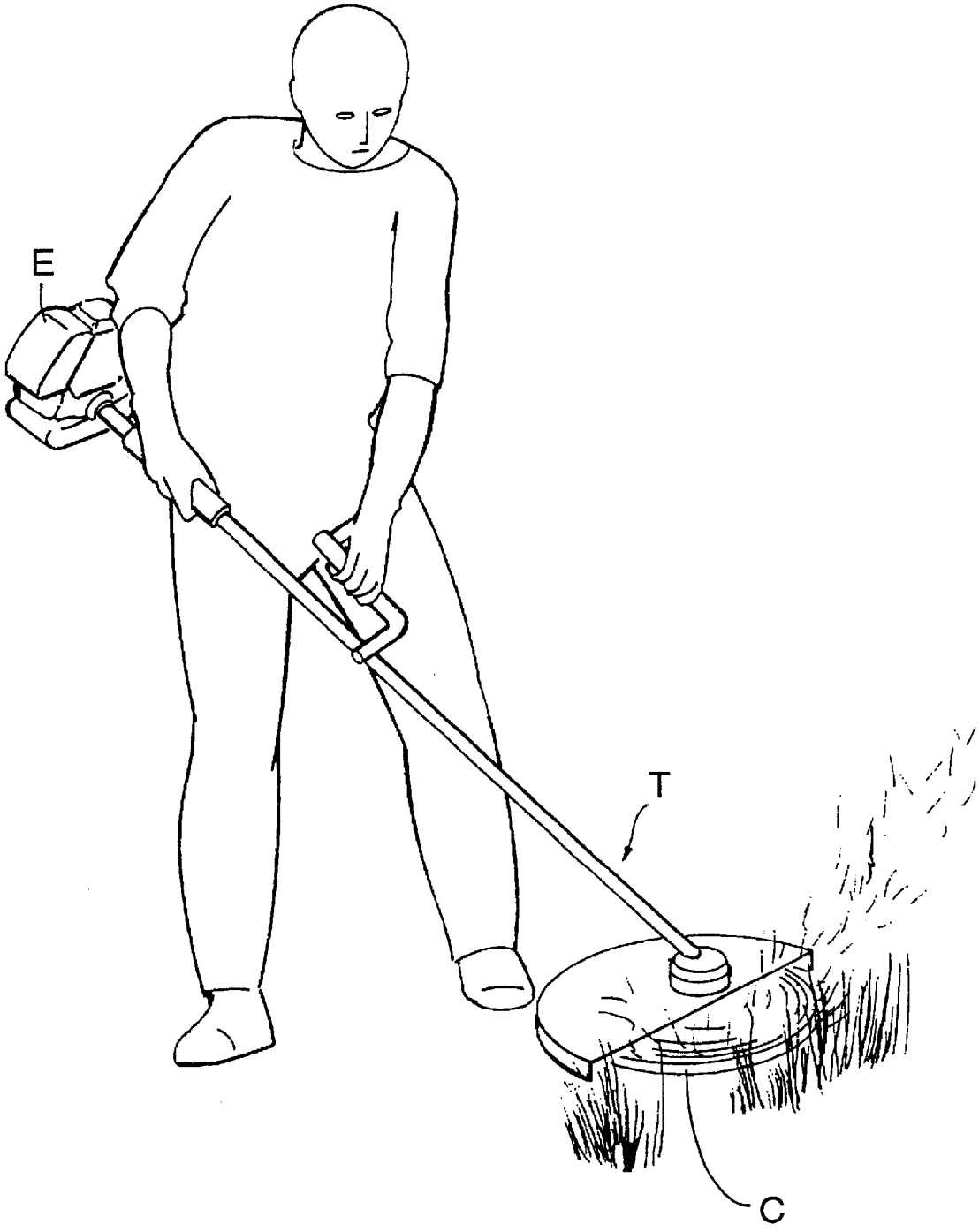
FIG. 1 is a perspective view of one application of a hand-held type 4-cycle engine according to the present invention.

As shown in FIG. 1, a hand-held type 4-cycle engine E is attached as a power source, for example, for a power trimmer T, to a drive section of the power trimmer T. The power trimmer T is used with its cutter C positioned in various directions depending on a working state thereof, and hence, in each case, the engine E is also inclined to a large extent, or turned upside down. Therefore, the operational attitude of the power trimmer T is variable.

First, the entire arrangement of the hand-held type 4-cycle engine E will be described with reference to FIGS. 2 to 5.

Figure 2:
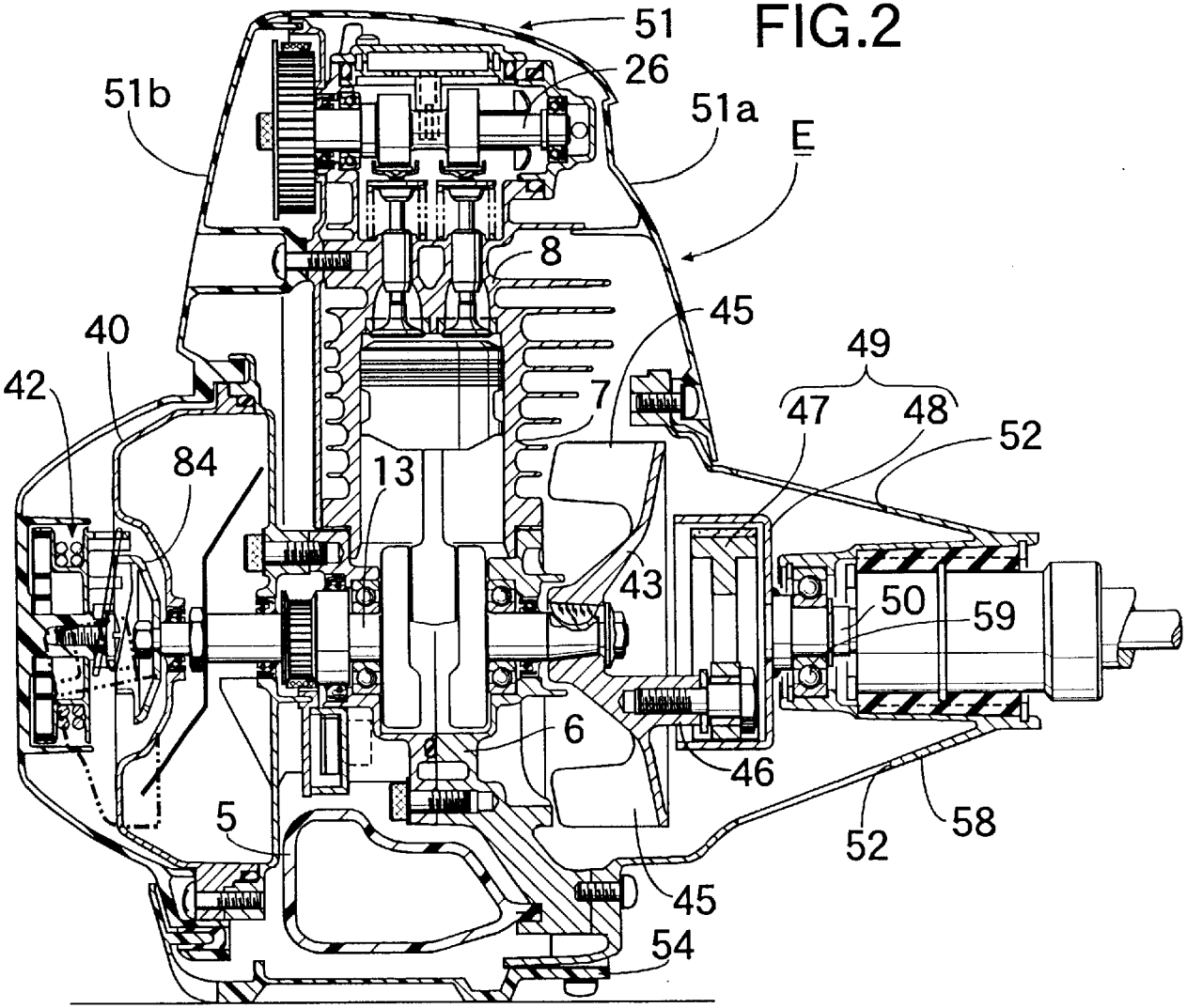
FIG. 2 is a vertical sectional side view of the 4-cycle engine.
Figure 3:
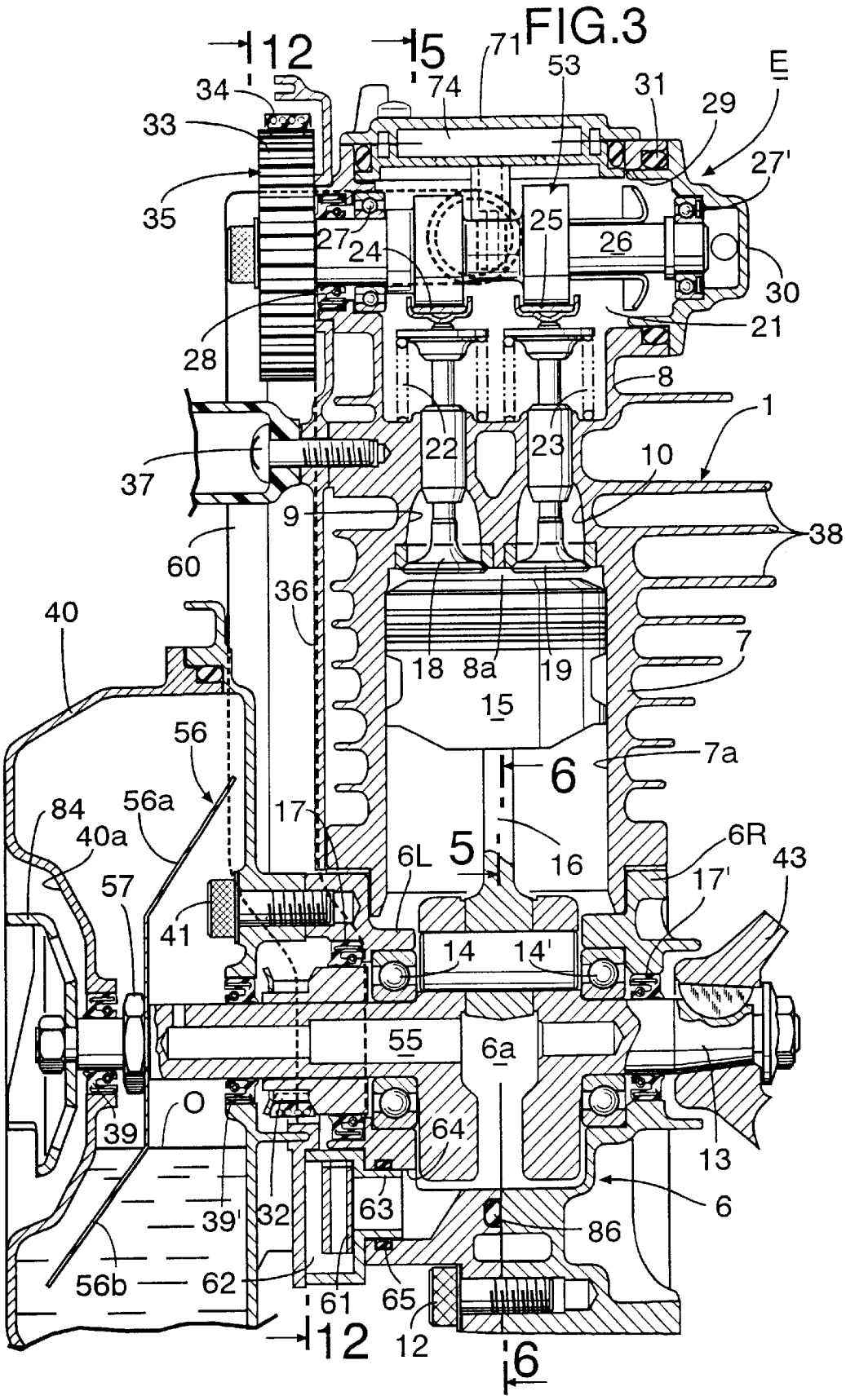
FIG. 3 is an enlarged view of an essential portion shown in FIG. 2.
Figure 5:
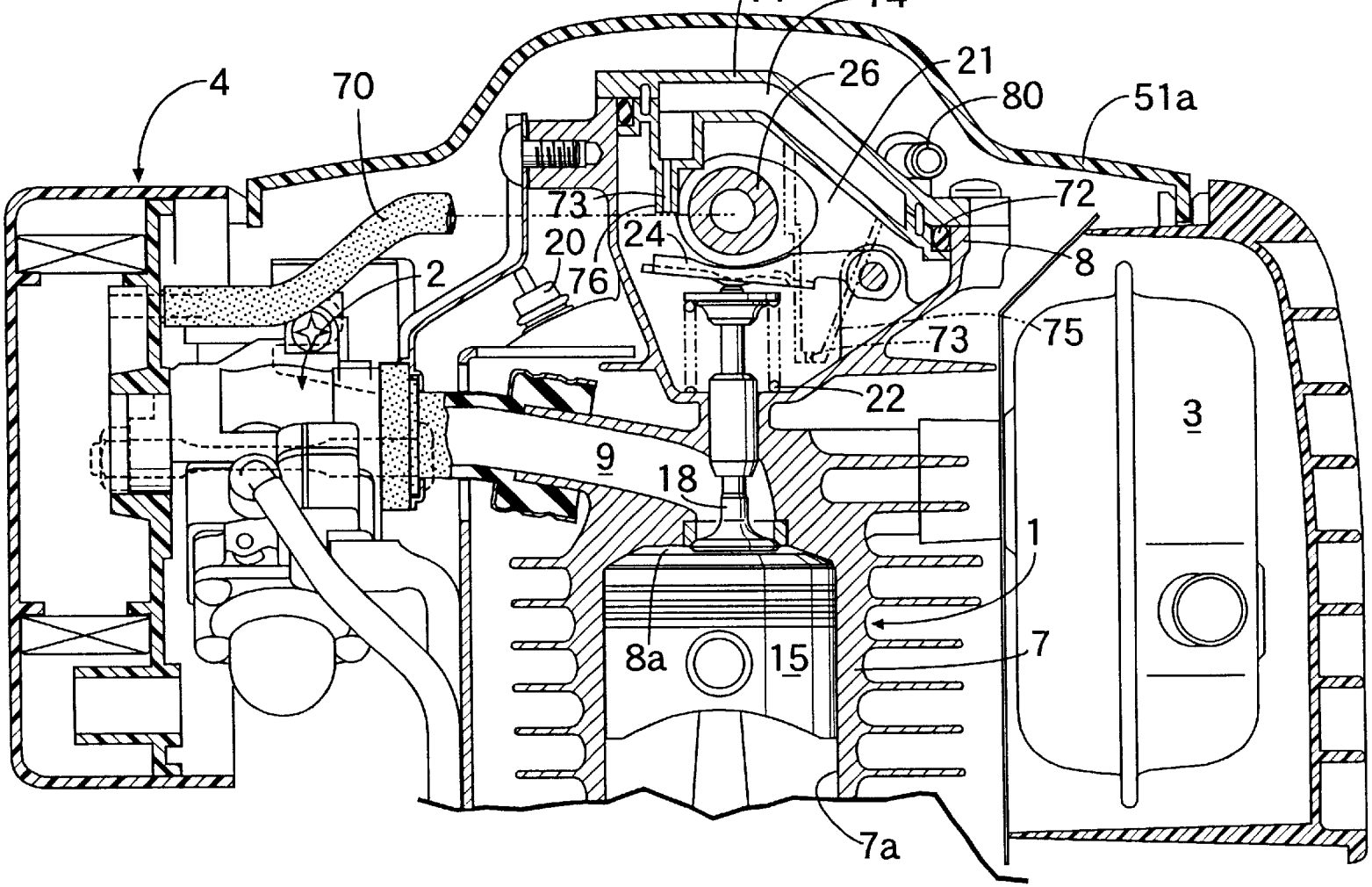
FIG. 5 is a sectional view taken along a line 5—5 in FIG. 3.
Figure 6:
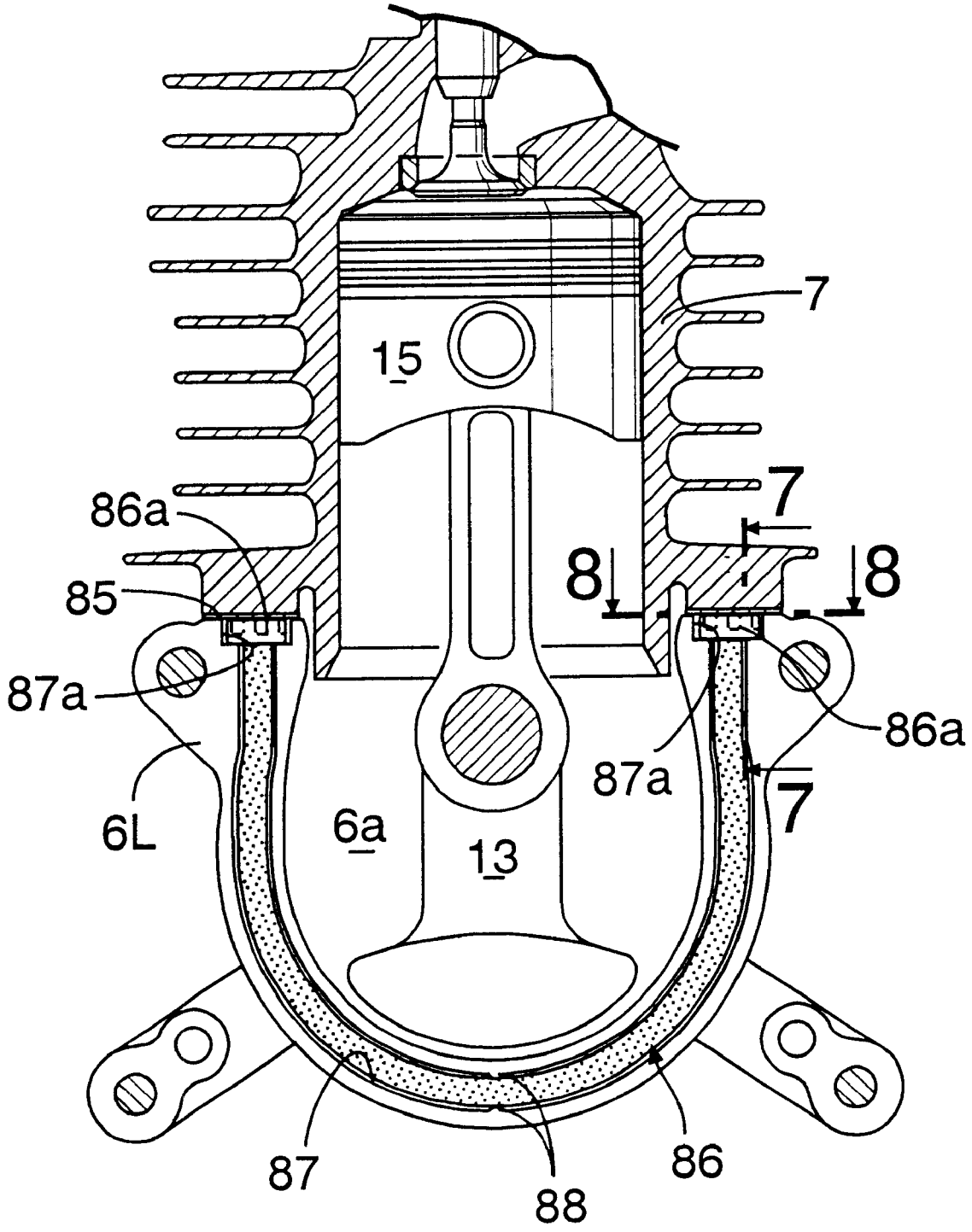
FIG. 6 is a sectional view taken along a line 6—6 in FIG. 3.
Figure 7:
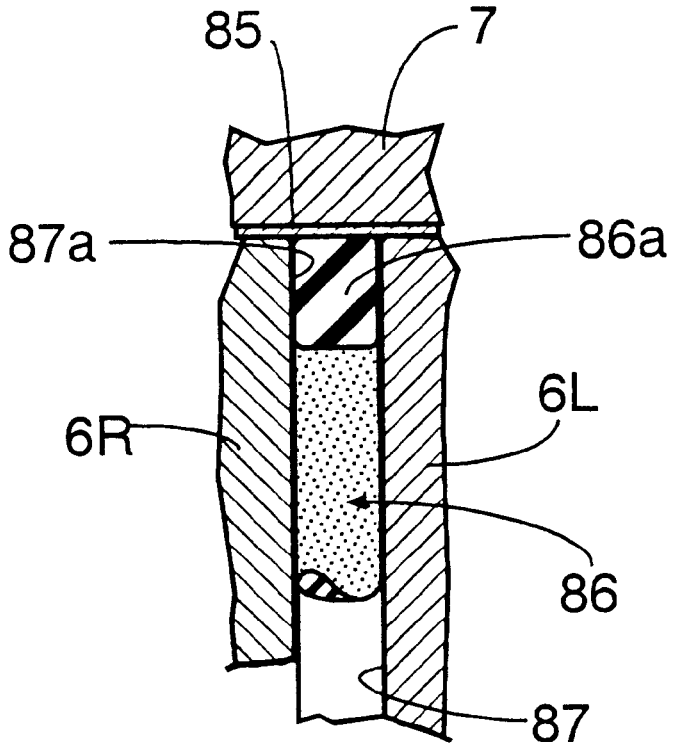
FIG. 7 is a sectional view taken along a line 7—7 in FIG. 6.
Figure 8:
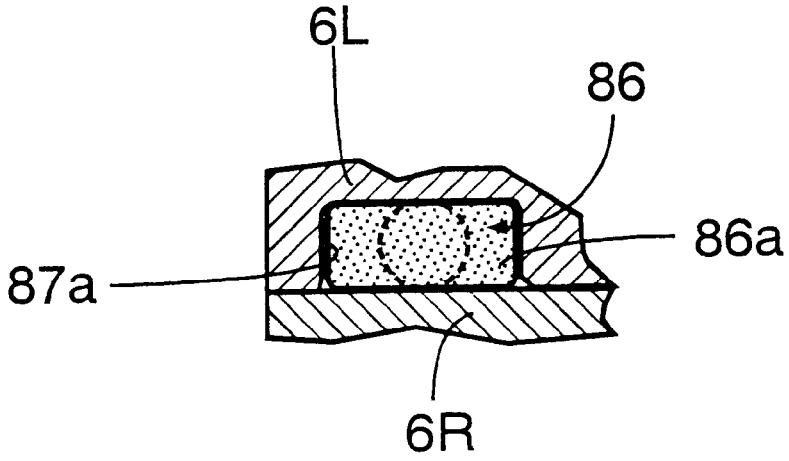
FIG. 8 is a sectional view taken along a line 8—8 in FIG. 6.
Figure 9:
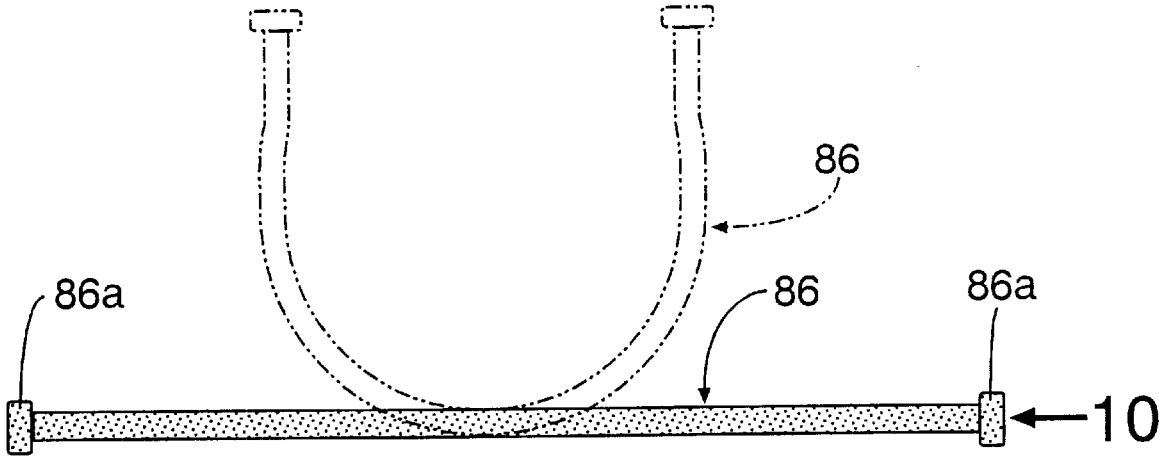
FIG. 9 is a front view of a bar-shaped seal member.
Figure 10:
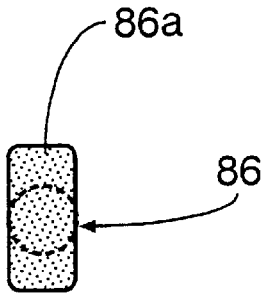
FIG. 10 is a view taken in a direction of an arrow 10 in FIG. 9.

As shown in FIGS. 2, 3 and 5, a carburetor 2 and an exhaust muffler 3 are mounted at front and rear locations on an engine body 1 of the hand-held type 4-cycle engine E, respectively, and an air cleaner 4 is mounted at an inlet of an intake passage of the carburetor 2. A fuel tank 5 made of a synthetic resin is mounted to a lower surface of the engine body 1.

The engine body 1 comprises a crankcase 6 having a crank chamber 6*a*, a cylinder block 7 having a single cylinder bore 7*a*, and a cylinder head 8 having a combustion chamber 8*a* and intake and exhaust ports 9 and 10 which open into the combustion chamber 8*a*. The cylinder block 7 and the cylinder head 8 are formed integrally with each other by casting, and the crankcase 6 formed separately from the cylinder block by casting is bolt-coupled to a lower end of the cylinder block 7. The crankcase 6 comprises first and second case halves 6L and 6R partitioned laterally from each other at a central portion of the crankcase 6 and coupled to each other by bolts 12. A large number of cooling fins 38 are formed around an outer periphery of each of the cylinder block 7 and the cylinder head 8.

A crankshaft 13 accommodated in the crank chamber 6*a* is rotatably carried on the first and second case halves 6L and 6R with ball bearings 14 and 14' interposed therebetween, and is connected through a connecting rod 16 to a piston 15 received in the cylinder bore 7*a*. Oil seals 17 and 17' are mounted on the first and second case halves 6L and 6R outside and adjacent to the bearings 14 and 14' to come into close contact with an outer peripheral surface of the crankshaft 13.

As shown in FIGS. 3 and 6 to 8, a gasket 85 is interposed between joints of the cylinder block 7 and the first/second case halves 6L/6R. A bar-shaped seal member 86 is interposed between the first and second case halves 6L and 6R in the following manner: A U-shaped seal groove 87 is formed in one of the joints of first and second case halves 6L and 6R to extend along an inner peripheral surface of such one joint, and an enlarged recess 87*a* extending over the joints of the case halves 6L 6R is formed at each of opposite ends of the seal groove 87 on the side of the cylinder block 7. On the other hand, the seal member 86 is made of an elastomer material such as rubber, and has a bar-shaped portion having a circular section. Enlarged end portions 86*a* having a square section are formed at opposite ends of the seal member 86 to protrude perpendicularly sideways in opposite directions. The seal member 86 is fitted into the seal groove 87, while the bar-shaped portion is being bent into a U-shape, with the enlarged end portions filled in the enlarged recesses 87*a*. In this case, it is effective for preventing the floating of an intermediate portion of the seal member 86 from the seal groove 87, to form a pair of small projections 88 on an inner surface of an intermediate portion of the seal groove 87 so that the projections 88 come into resilient contact with an outer peripheral surface of an intermediate area of the bar-shaped portion.

When the first and second case halves 6L and 6R are coupled to each other, outer surfaces of the bar-shaped portion and the enlarged ends 86*a* of the seal member 86 are put into close contact with the opposed mating joint surfaces. When the cylinder block 7 is coupled to the upper surfaces of the case halves 6L and 6R with the gasket 85 interposed therebetween, upper surfaces of the enlarged ends 86*a* are put in close contact with the gasket 85. In this manner, the joint surfaces of the case halves 6L and 6R and the cylinder block 7 intersecting each other in a T-shape are sealed by the single seal member 86 and the single gasket 85. In particular, the entire seal member 86 can be retained accurately at a fixed position without the need for a special skill, by the fitting of the pair of enlarged ends 86 in the enlarged recesses 87*a* and moreover, interferences for the bar-shaped portion and the enlarged ends 86*a* of the seal member 86 are determined by the depths of the seal grove 87 and the enlarged recesses 87*a* for accommodation of the bar-shaped portion and the enlarged ends 86*a*, and little influenced by variation the pressure of coupling between the joint surfaces. Therefore, it is possible to reliably achieve the sealing of the intersecting joint surfaces, while providing ease of assembly of the engine body 1.

Referring again to FIGS. 4 and 5, an intake valve 18 and an exhaust valve 19 are mounted in the cylinder head 8 in parallel to an axis of the cylinder bore 7*a* for opening and closing the intake port 9 and the exhaust port 10, respectively. A spark plug 20 is threadedly mounted with its electrode disposed in proximity to a central portion of the combustion chamber 8*a*.

The intake valve 18 and the exhaust valve 19 are urged to closing directions by valve springs 22 and 23 in a valve-operating cam chamber 21 defined in the cylinder head 8. In the valve-operating cam chamber 21, rocker arms 24 and 25 vertically swingably supported on the cylinder head 8 are superposed on heads of the intake valve 18 and the exhaust valve 19. A cam shaft 26 for opening and closing the intake valve 18 and the exhaust valve 19 through the rocker arms 24, 25 are rotatably carried on laterally opposite sidewalls of the valve-operating cam chamber 21 in parallel to the crankshaft 13 with ball bearings 27 and 27' interposed therebetween. One of the sidewalls of the valve-operating cam chamber 21, on which one of the ball bearings 27 is mounted, is formed integrally with the cylinder head 8, an oil seal 28 is mounted on such one sidewall adjacent to and outside the bearing 27 to come into close contact with an outer peripheral surface of the cam shaft 26. An insertion hole 29 is provided in the other sidewall of the valve-operating cam chamber 21 to enable the insertion of the camshaft 26 into the chamber 21, and the other ball bearing 27' is mounted on a bearing cap 30 adapted to close the insertion hole 29 after insertion of the camshaft 26. The bearing cap 30 is fitted into the insertion hole 29 with a seal member 31 interposed therebetween, and is bolt-coupled to the cylinder head 8.

Figure 4:
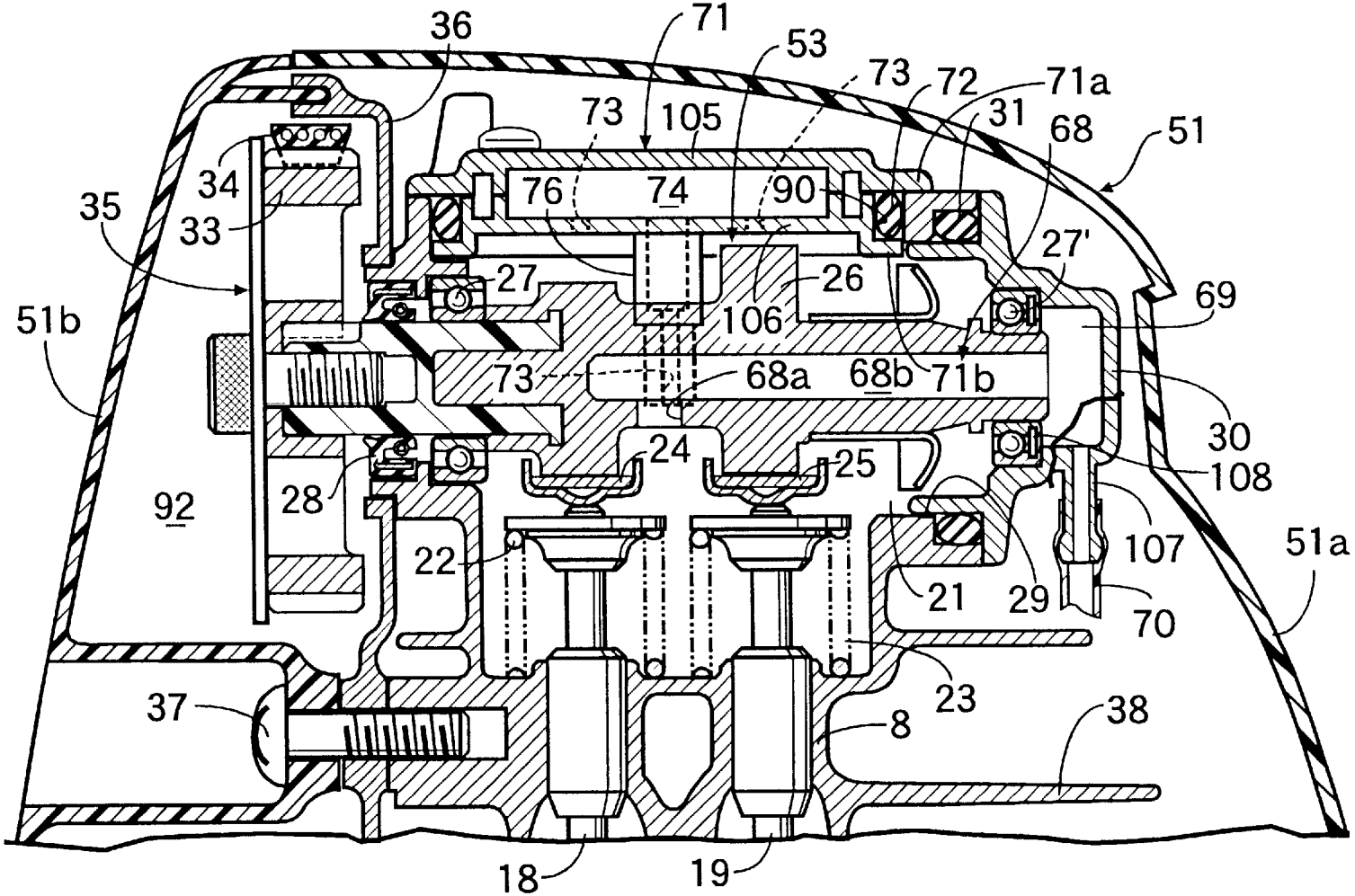
FIG. 4 is an enlarged vertical sectional view of a section around a camshaft.
Figure 11:
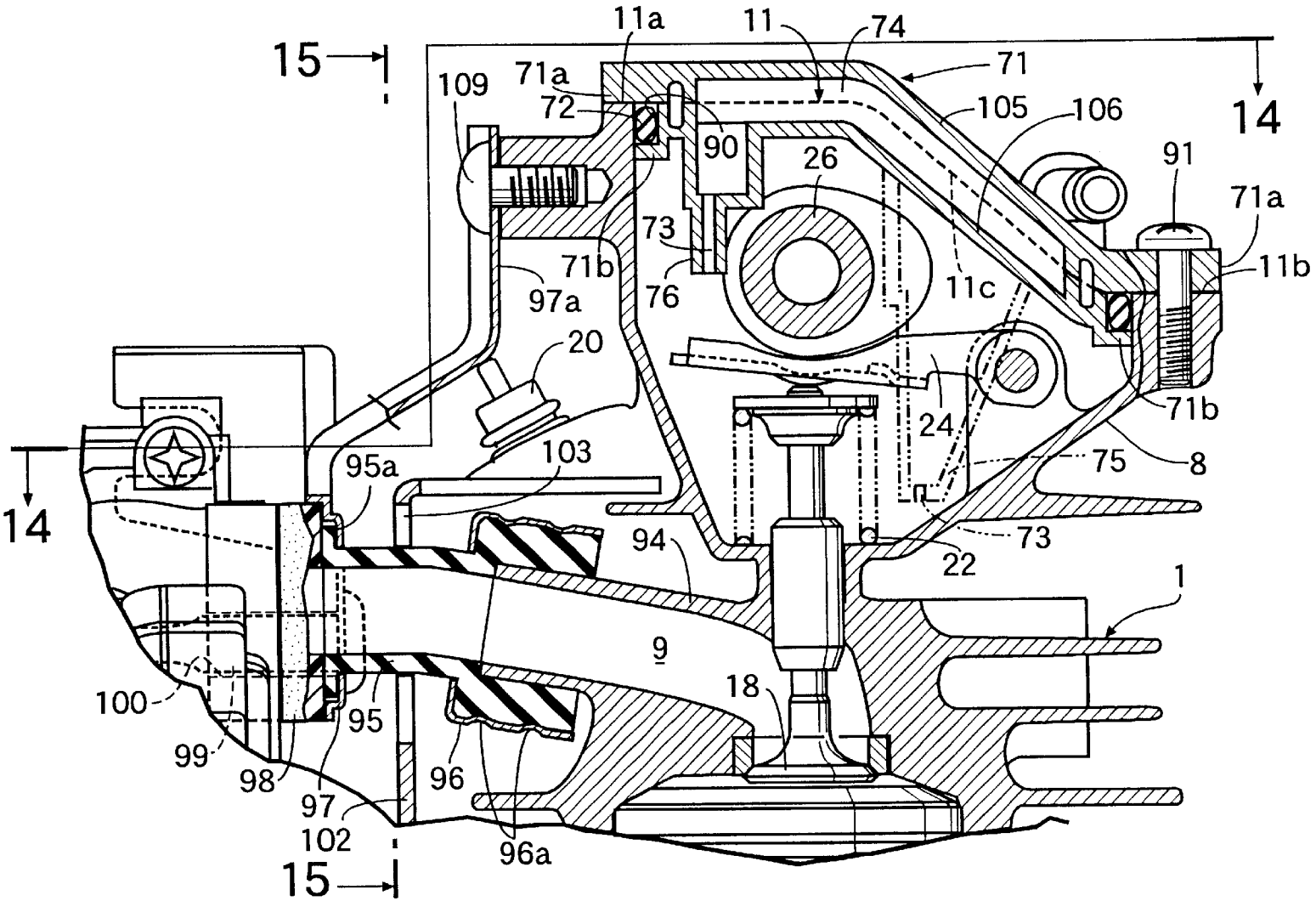
FIG. 11 is an enlarged view of an essential portion shown in FIG. 5.
Figure 16:
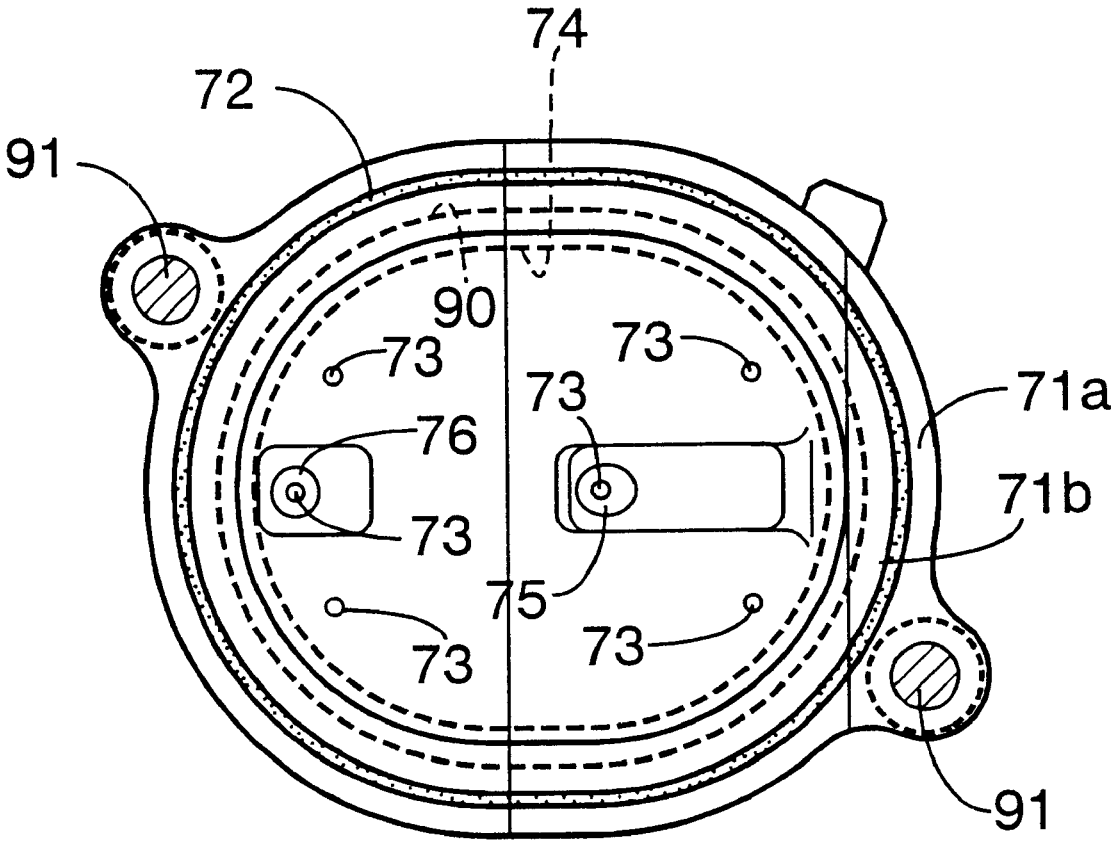
FIG. 16 is a bottom view of a head cover.

As best shown in FIGS. 4, 11 and 16, a head cover 71 is coupled to an upper end face of the cylinder head 8 to close an open surface of the valve-operating cam chamber 21.

The upper end face 11 of the cylinder head 8 is comprised of a slant 11*c* inclined downwards from the side of the camshaft 26 toward a fulcrum of swinging movement of the rocker arms 24 and 25, and a pair of flat face portions 11*a* and 11*b* connected to opposite ends of the slant 11*c* and parallel to each other at different height levels. The head cover 71 is formed with a flange portion 71*a* superposed on the upper end face 11 of the cylinder head 8, and a fit wall 71*b* fitted to an inner peripheral surface of the valve-operating cam chamber 21. An annular seal groove 90 is provided in an outer peripheral surface of the fit wall 71*b*, and an O-ring 72 as a seal member is mounted in the seal groove 90 to come into close contact with the inner peripheral surface of the valve-operating cam chamber 21. The flange portion 71*a* is secured to the cylinder head 8 by a pair of parallel bolts 91, 91 at locations corresponding to the pair of flat face portions 11*a* and 11*b*.

When the fit wall 71*b* of the head cover 71 is fitted to the inner peripheral surface of the valve-operating cam chamber 21 with the O-ring 72 interposed therebetween in the above manner, a uniform interference can be provided at each of various portions of the O-ring 72 irrespective of an axial force of the bolt 91, thereby ensuring a good sealed state between the cylinder head 8 and the head cover 71. Moreover, the bolt 91 for securing the flange portion 71*a* of the head cover 71 to the cylinder head 8 only performs the securing of the flange portion 71*a* to the cylinder head 8 without participation in the interference for the O-ring 72 and hence, the number of bolts 91 used can be reduced substantially. Particularly, if the flange portion 71*a* of the head cover 71 is secured to the cylinder head 8 by a pair of parallel bolts 91, 91 at locations corresponding to the pair of flat face portions 11*a* and 11*b*, the head cover 71 can be secured simply and reliably by a small number of bolts.

One end of the camshaft 26 protrudes outwards from the cylinder head 8 on the side where the oil seal 28 is located. On the same side, one end of the crankshaft 13 also protrudes outwards from the crankcase 6, and a toothed driving pulley 32 is secured to such one end, while a toothed driven pulley 33 having a number of teeth two times those of the driving pulley 32 is secured to the one end of the camshaft 26. A toothed timing belt 34 is wound around the pulleys 32 and 33, so that the crankshaft 13 can drive the camshaft 26 at a reduction ratio of one half. A valve-operating mechanism 53 is constituted by the camshaft 26 and a timing-transmitting device 35.

Thus, the engine E is constructed into an OHC type, and the timing-transmitting device 35 is disposed as a dry type outside the engine body 1.

Figure 12:
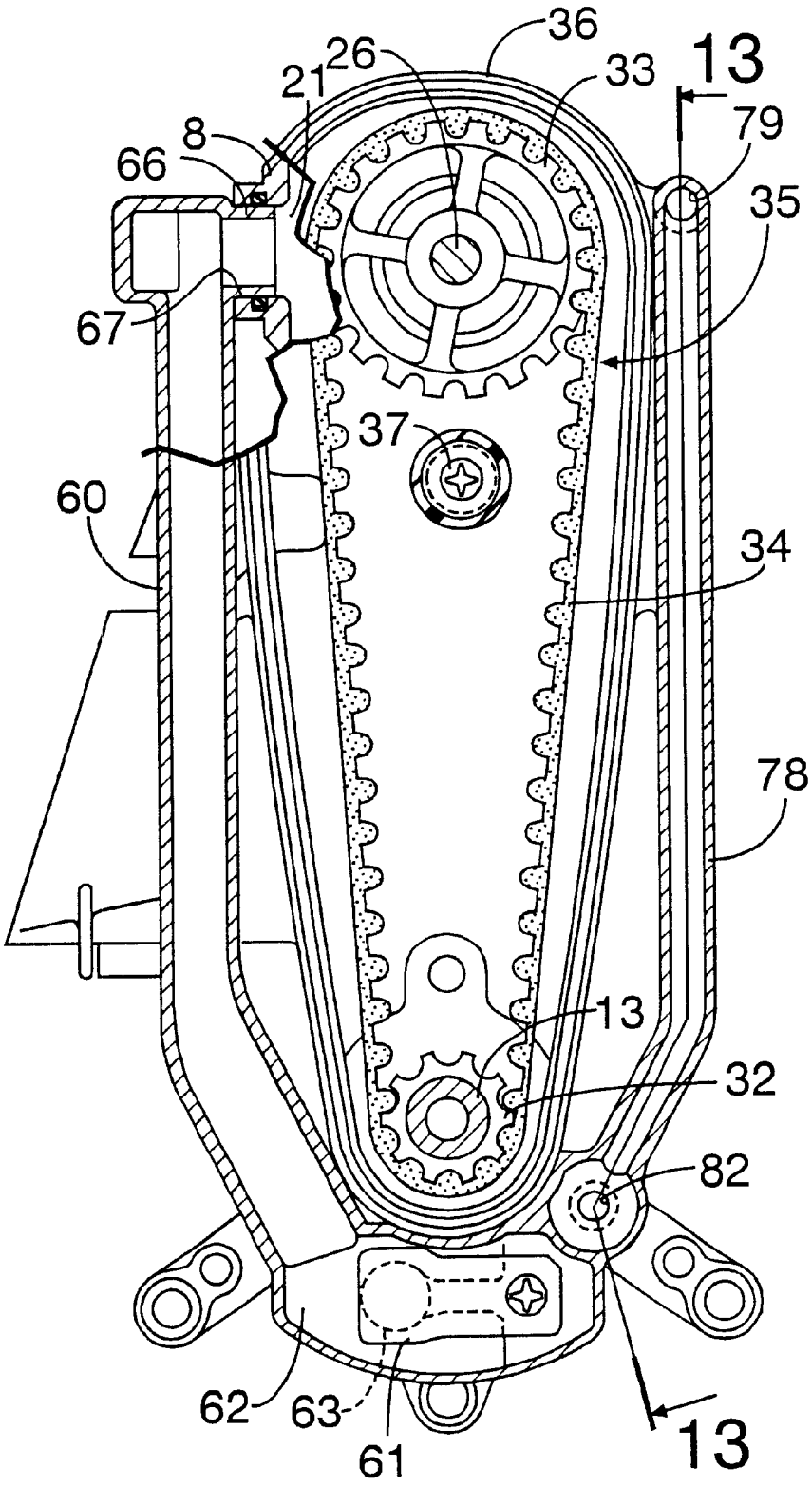
FIG. 12 is a sectional view taken along a line 12—12 in FIG. 3.

As shown in FIGS. 3 and 12, a belt cover 36 made of a synthetic resin is disposed between the engine body 1 and the timing transmitting device 35, and fixed to the engine body 1 by a bolt 37, thereby avoiding the influence of heat radiated from the engine body 1 to the timing transmitting device 35.

An oil tank 40 made of a synthetic resin is disposed on the timing transmitting device 35 to cover an outer surface of a portion of the timing transmitting device 35, and secured to the engine body 1 by a bolt 41. Further, a recoil starter 42 (see FIG. 2) is attached to an outer surface of the oil tank 40.

Referring again to FIG. 2, the other end of the crankshaft 13 opposite from the timing transmitting device 35 also protrudes outwards from the crankcase 6, and a flywheel 43 is secured to this end of the crankshaft 13 by a nut 44. The flywheel 43 has a large number of cooling blades 45 integrally provided on its inner surface to serve as a cooling fan. The flywheel also has a plurality of mounting bosses 46 (one of which is shown in FIG. 2) formed on its outer surface, and a centrifugal shoe 47 is swingably supported on the mounting bosses 46. The centrifugal shoe 47 constitutes a centrifugal clutch 49 together with a clutch drum 48 secured to a drive shaft 50 which will be described hereinafter. When the rotational speed of the crankshaft 13 exceeds a predetermined value, the centrifugal shoe 47 is brought into pressure contact with an inner peripheral wall of the clutch drum 48 by its own centrifugal force, to transmit a torque output from the crankshaft 13 to the drive shaft 50. The diameter of the flywheel 43 is greater than the diameter of the centrifugal clutch 48.

An engine cover 51 covering the engine body 1 and its accessories is divided at a location corresponding to the timing transmitting device 35 into a first cover half 51*a* on the side of the flywheel 43, and a second cover half 51*b* on the side of the starter 42. The first and second cover halves 51*a* and 51*b* are secured to the engine body 1. A frustoconical bearing holder 58 is arranged coaxially with the crankshaft 6 and secured to the first cover half 51*a*. The bearing holder 58 supports the cutter C with a bearing 59 interposed therebetween to drive the cutter C to rotate, and an air intake port 52 is provided in the bearing holder 75 so that the external air is introduced into the engine cover 51 with rotation of the cooling blades 45. A pedestal 54 is secured to the engine cover 51 and the bearing holder 75 to cover a lower surface of the fuel tank 5.

The second cover half 51*b* defines a timing-transmitting chamber 92 for accommodation of the timing-transmitting device 35 in cooperation with the belt cover 36.

Thus, the timing-transmitting device 35 adapted to operate the crankshaft 13 and the camshaft 26 in association with each other is constructed into a dry type and disposed outside the engine body 1. Therefore, it is unnecessary to specially provide a chamber for accommodation of the timing-transmitting device 35 and hence, it is possible to provide a reduction in wall thickness and a compactness of the engine body 1 to achieve a remarkable reduction in the weight of the entire engine E.

Moreover, the timing transmitting device 35 and the centrifugal shoe 47 of the centrifugal clutch 49 are connected to opposite ends of the crankshaft 13 with the cylinder block 7 interposed therebetween. Therefore, a good balance of weight is provided between the opposite ends of the crankshaft 13, and the center of gravity of the engine E can be put extremely close to a central portion of the crankshaft 13, leading to a reduction in weight and an enhancement in operability of the engine E. Furthermore, during operation of the engine E, a load provided by the timing transmitting device 35 and the drive shaft 50 is applied in a dispersed manner to the opposite ends of the crankshaft 13. Therefore, it is possible to avoid the localization of the load on the crankshaft 13 and the bearings 14 and 14' supporting the crankshaft 13, to thereby enhance durability of them.

The flywheel 43 larger in diameter than the centrifugal shoe 47 and having the cooling blades 45 is secured to the crankshaft 13 between the engine body 1 and the centrifugal shoe 47. Therefore, it is possible to draw in the external air through the air intake port 52 by the rotation of the cooling blades 45, to properly supply it around the cylinder block 7 and the cylinder head 8 without being obstructed by the centrifugal clutch 48, thereby enhancing the cooling of the cylinder block 7 and the cylinder head 8, while avoiding an increase in the size of the engine E due to the flywheel 43.

Further, the oil tank 40 is mounted to the engine body 1 adjacent to and outside the timing transmitting device 35. Therefore, the oil tank 40 covers at least a portion of the timing-transmitting device 35, thereby protecting the timing-transmitting device 35 in cooperation with the second cover half 51*b* covering the other portion of the timing-transmitting device 35. Moreover, since the oil tank 40 and the flywheel 43 are disposed to oppose to each other with the engine body 1 interposed therebetween, the center of gravity of the engine E can be put close to the central portion of the crankshaft 13.

As shown in FIGS. 5, 11, 14 and 15, an intake tube 94 having the intake port 9 is integrally provided in a projecting manner on one side of the cylinder head 8, and the carburetor 2 is connected to the intake tube 94 through an intake pipe 95 made of an elastomer material such as rubber. One end of the intake pipe 95 is fitted over an outer periphery of the intake tube 94. Further, a clamping ring 96 is fitted over an outer periphery of the intake pipe 95, and a plurality of annular caulking grooves 96*a* are defined on the clamping ring 96. In this manner, the intake pipe 95 is connected to the intake tube 94. A flange 95*a* is formed at the other end of the intake pipe 95, and a support plate 97 and an insulator 98 made of an insulating material are disposed in a superposed relation to each other such that the flange 95*a* is sandwiched therebetween. A pair of connecting bolts 99 are welded at their heads to the support plate 97 and inserted into a series of bolt bores 100 formed through the insulator 98, the carburetor 2 and a bottom wall of a case 4*a* of the air cleaner 4, and nuts 101 are threadedly fitted and clamped over tip ends of the connecting bolts 99, whereby the intake pipe 95, the insulator 98, the carburetor 2 and the air cleaner 4 are mounted to the support plate 97.

A stay 97*a* is integrally formed with the support plate 97, and fixed to the cylinder head 8 by a bolt 109.

A heat-shielding air guide plate 102 is disposed between the engine body 1 and carburetor 2. The heat-shielding air guide plate 102 is made of a synthetic resin and integrally connected to one side of the belt cover 36, and has an opening 103 through which the intake pipe 95 is passed. Further, the heat-shielding air guide plate 102 extends until its lower end reaches near the flywheel, that is, the cooling fan 43.

Thus, cooling air fed from the cooling fan 43 can be guided by the heat-shielding air guide plate 102 to the engine body 1 and particularly to the cylinder head 8, to effectively cool them. The heat-shielding air guide plate 102 is adapted to shield a radiated heat of the engine body 1 to prevent the overheating of the carburetor 2. The heat-shielding air guide plate 102 is formed integrally with the belt cover 36, thereby providing a reduction in number of parts and in its turn, simplifying the structure.

A lubricating system for the engine E will be described below with reference to FIGS. 3, 13 and 16 to 18F.

As shown in FIG. 3, the crankshaft 13 is disposed such that one end thereof is passed through the oil tank 40, while being in closed contact with the oil seals 39 and 39' mounted to outer and inner sidewalls of the oil tank 40, respectively. A through-bore 55 is provided in the crankshaft 13 to provide communication between the inside of the oil tank 40 and the crank chamber 6*a*. Lubricating oil is stored in the oil tank 40 in an amount determined so that an end of the through-bore 55 opened into the oil tank 40 is always exposed above the liquid level of the oil O, regardless of the operational position of the engine E.

A bowl-shaped portion 40*a* is formed in an outer wall of the oil tank 40 and recessed into the tank 40. In the oil tank 40, an oil slinger 56 is secured to the crankshaft 13 by a nut 57. The oil slinger 56 includes two blades 56*a* and 56*b* which extend radially opposite to each other from the central portion where the oil slinger 56 is fitted to the crankshaft 13. One of the blades 56*a* is bent at its intermediate portion toward the engine body 1, and the other blade 56*b* is bent at its intermediate portion to extend along a curved surface of the bowl-shaped portion 40*a*. When the oil slinger 56 is rotated by the crankshaft 13, at least one of the two blades 56*a* and 56*b* scatters the oil O stored in the oil tank 40 in any operational position of the engine E to generate an oil mist.

Particularly, the formation of the bowl-shaped portion 40*a* on the outer wall of the oil tank 40 ensures that a dead space within the oil tank 40 can be reduced and, moreover, the oil present around the bowl-shaped portion 40*a* can be stirred and scattered by the blade 56*b* even in a laid-sideways position of the engine E with the bowl-shaped portion 40*a* facing downwards.

The oil seal 39 is attached to the central point of the bowl-shaped portion 40*a* to come into close contact with the outer peripheral surface of the crankshaft 13 passing through the bowl-shaped portion 40*a*, and a driven member 84 is disposed within the bowl-shaped portion 40*a* and secured to a tip end of the crankshaft 13 so that it is driven by the recoil starter 42.

With the above-described arrangement, a space in the bowl-shaped portion 40*a* can be effectively utilized for the disposition of the driven member 84, and the recoil starter 42 can be disposed in proximity to the oil tank 40, which permits the entire engine E to be more compact.

Figure 17:
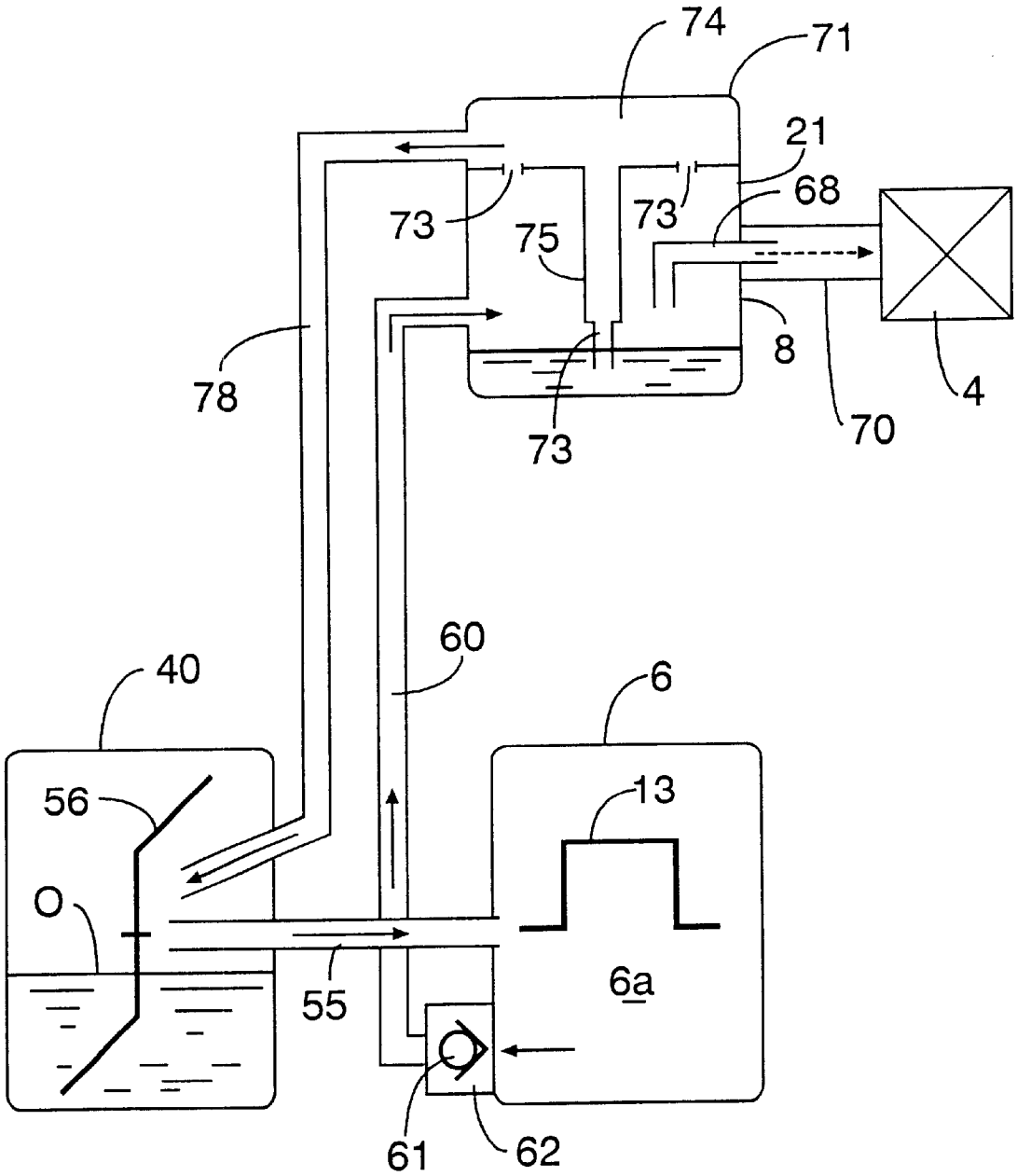
FIG. 17 is a diagram of a lubricating system in the engine.
Figures 18A, 18B, 18C, 18D, 18E, 18F:
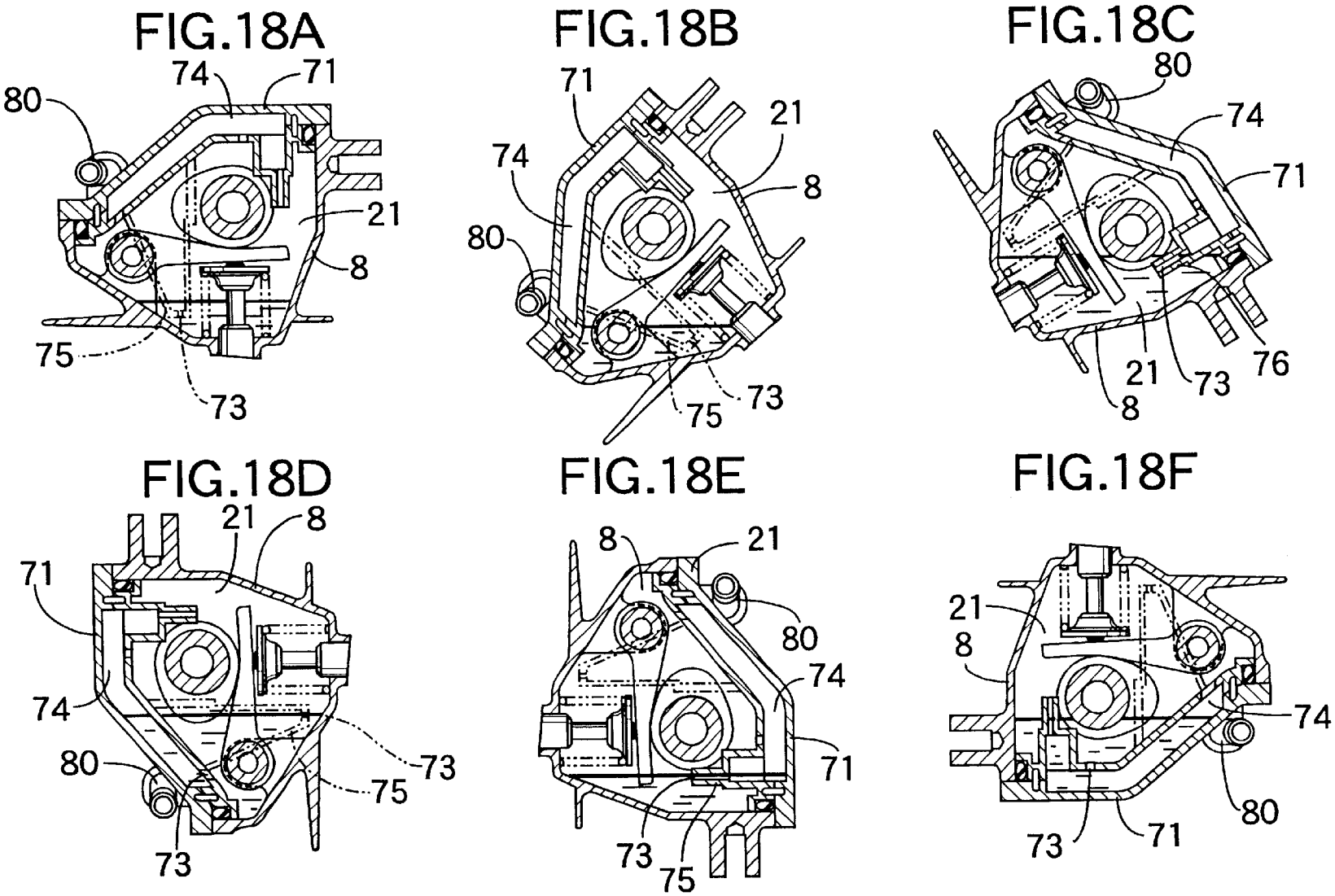
FIGS. 18A to 18F are views for explaining an action of drawing up an oil accumulated in a cylinder head in various operational attitudes of the engine.

Referring to FIGS. 3, 12 and 17, the crank chamber 6*a* is connected to the valve-operating cam chamber 21 through an oil-feed conduit 60, and a one-way valve 61 is incorporated in the oil-feed conduit 60 for permitting a flow of oil in only one direction from the crank chamber 6*a* to the valve-operating cam chamber 21. The oil-feed conduit 60 is integrally formed on the belt cover 36 to extend along one sidewall of the belt cover 36, with its lower end formed in a valve chamber 62. An inlet pipe 63 is integrally formed on the belt cover 36 to protrude from the valve chamber 62 at the back of the belt cover 36, and is fitted into a connecting bore 64 in a lower portion of the crankcase 6 with a seal member 65 interposed therebetween, to communicate with the crank chamber 6*a*. The one-way valve 61 is disposed in the valve chamber 62 to permit the flow of oil in only one direction from the inlet pipe 63 to the valve chamber 62. The one-way valve 61 is a reed valve in the illustrated embodiment.

An outlet pipe 66 is integrally formed on the belt cover 36 to protrude from an upper end of the oil-feed conduit 60 at the back of the belt cover 36, and is fitted into a connecting bore 67 in a side of the cylinder head 8, to communicate with the valve-operating cam chamber 21.

The head cover 71 is comprised of an outer cover plate 105 made of a synthetic resin and having the flange portion 71*a*, and an inner cover plate 106 made of a synthetic resin and having the fit wall portion 71*b*, the outer and inner cover plates 105 and 106 being friction-welded to each other. The outer and inner cover plates 105 and 106 are formed to define a drawing-up chamber 74 therebetween.

The drawing-up chamber 74 is of a flat shape to extend over the upper face of the valve-operating cam chamber 21, and four orifices 73 are defined at four points in the bottom wall of the drawing-up chamber 74, i.e., the inner cover plate 105. Two long and short drawing-up pipes 75 and 76 are integrally formed in the bottom wall of the drawing-up chamber 74 at central locations thereof, and arranged at a distance along a direction perpendicular to the axis of the camshaft 26, to protrude into the valve-operating cam chamber 21, and an orifice 73 is provided in each of the drawing-up pipes 75 and 76.

Figure 13:
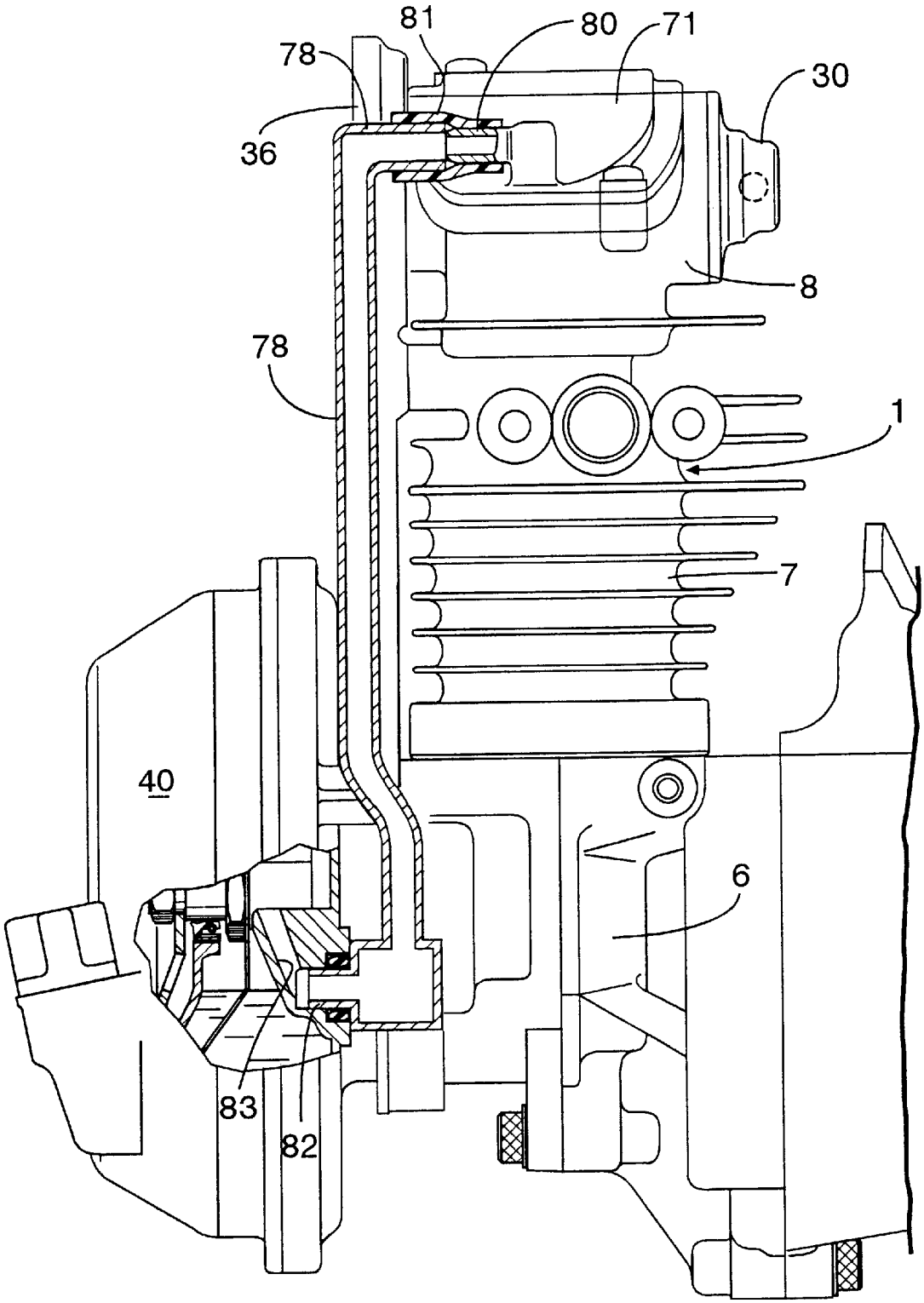
FIG. 13 is a sectional view taken along a line 13—13 in FIG. 12.
Figure 14:
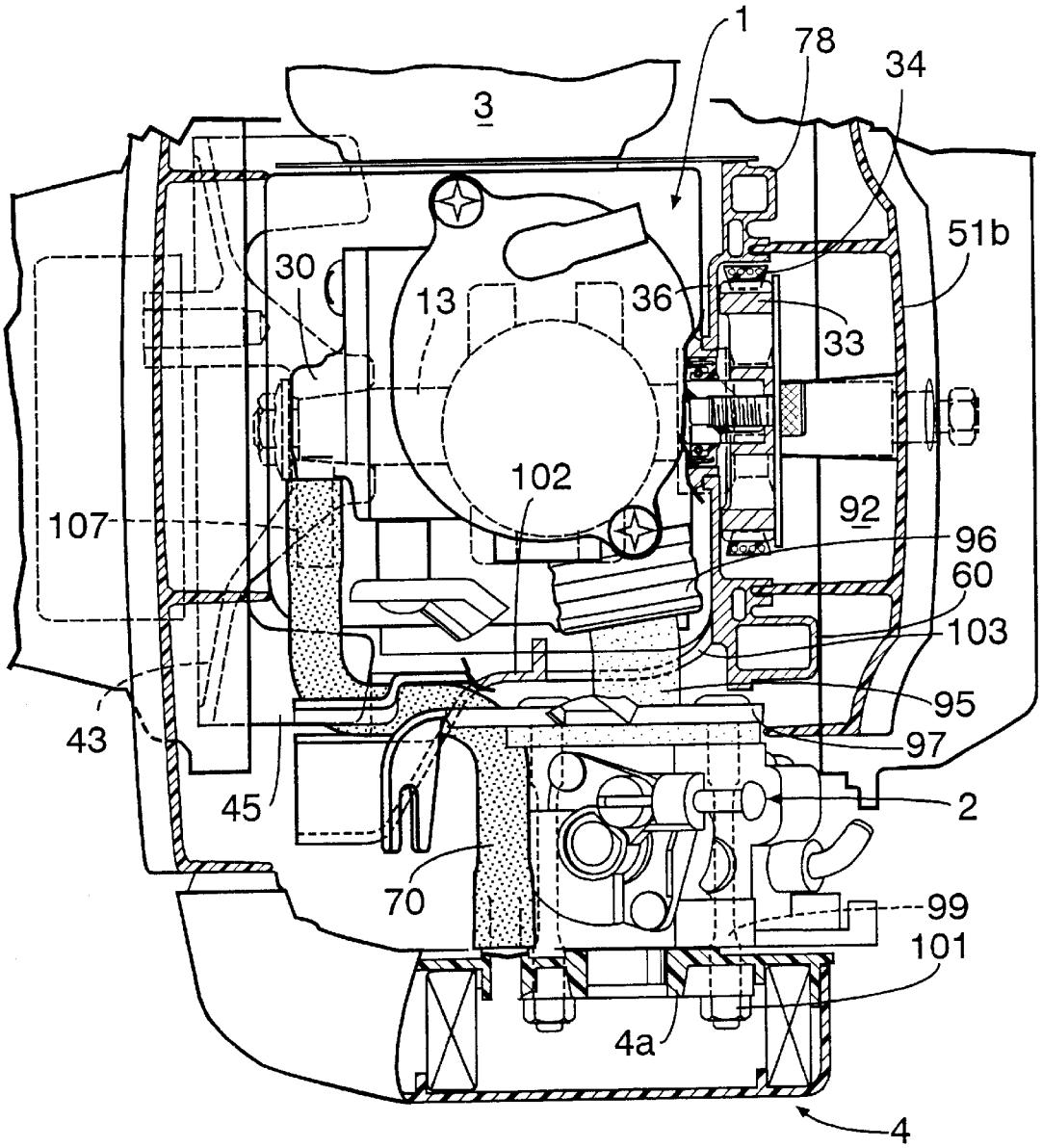
FIG. 14 is a sectional view taken along a line 14—14 in FIG. 11.
Figure 15:
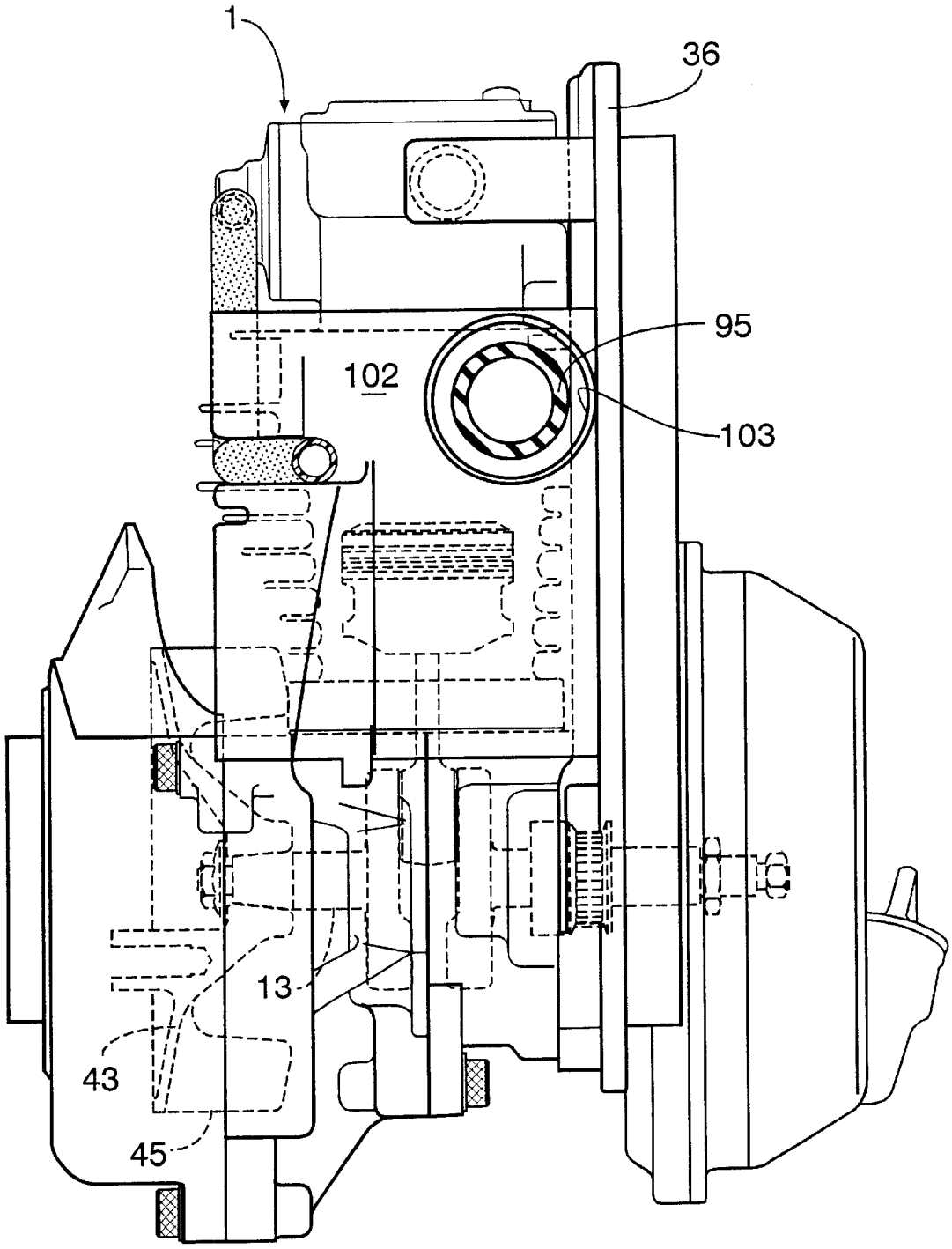
FIG. 15 is a sectional view taken along a line 15—15 in FIG. 11.

As shown in FIGS. 12, 13 and 17, the drawing-up chamber 74 also communicates with the inside of the oil tank 40 through an oil-return conduit 78. The oil-return conduit 78 is integrally formed on the belt cover 36 to extend along the side edge opposite from the oil-feed conduit 60. An inlet pipe 79 is integrally formed on the belt cover 36 to protrude from an upper end of the oil-return pipe 78 at the back of the belt cover 36, and connected to an outlet pipe 80 formed in the head cover 71 through a connector 81, to communicate with the drawing-up chamber 74.

An outlet pipe 82 is integrally formed in the belt cover 36 to protrude from a lower end of the oil-return conduit 78 at the back of the belt cover 36, and is fitted into a return bore 83 provided in the oil tank 40, to communicate with the inside of the oil tank 40. An open end of the return bore 83 is disposed in the vicinity of a central portion of the inside of the oil tank 40 so that it is exposed above the liquid level of the oil in the oil tank 40 regardless of the operational position of the engine E.

As best shown in FIG. 4, a breather passage 68 is provided in the camshaft 26. The breather passage 68 comprises a shorter side bore portion 68*a* as an inlet which opens at an axially intermediate portion of the camshaft 26 toward the valve-operating cam chamber 21, and a longer through bore portion 68*b* which extends through a center portion of the camshaft 26 and opens at an end face thereof on the side of the bearing cap 30. An enlarged breather chamber 69 is defined in the bearing cap 30 to communicate with an exit of the through bore 68*b*, and a pipe-connecting tube 107 is formed on the baring cap 30 and protrudes from an outer surface thereof to communicate with the breather chamber 69. The breather chamber 69 communicates with the inside of the air cleaner 4 through a breather pipe 70 connected to the pipe-connecting tube 107.

The ball bearing 27' retained on the bearing cap 30 is formed in a sealed structure including a seal member 108 on a side facing the breather chamber 69. Therefore, the oil mist in the valve-operating cam chamber 21 can lubricate the ball bearing 27', but cannot reach the breather chamber 69 through the bearing 27'.

Thus, the oil slinger 56 scatters the lubricating oil O in the oil tank 40 by the rotation of the crankshaft 13 during operation of the engine E, to generate the oil mist. When the pressure of the crank chamber 6*a* decreases due to the ascending movement of the piston 15, the oil mist is drawn into the crank chamber 6*a* through the through-bore 55, to lubricate the crankshaft 13 and the periphery of the piston 15. When the pressure of the crank chamber 6*a* increases due to the descending movement of the piston 15, the one-way valve 61 opens, so that the oil mist ascends through the oil-feed conduit 60 along with a blow-by gas generated in the crank chamber 6*a* and is supplied to the valve-operating cam chamber 21 to lubricate the camshaft 26, the rocker arms 24 and 25 and the others.

When the oil mist and the blow-by gas in the valve-operating cam chamber 21 flow into the side bore portion 68*a* of the breather passage 68 in the camshaft 26 which is being rotated, they are separated from each other by centrifugation in the rotated side bore portion 68*a*. Then, the oil is returned to the valve-operating cam chamber 21, and the blow-by gas is drawn into the engine E sequentially through the side bore portion 68*a* and the through bore portion 68*b* in the breather passage 68, the breather chamber 69, the breather pipe 70 and the air cleaner 4.

The breather chamber 69 and the pipe-connecting tube 107 connecting the breather pipe 70 are formed in and on the bearing cap 30 retaining the ball bearing 27' for supporting the camshaft 26, as described above. Therefore, the bearing cap 30 also serves as a transfer member for transferring the blow-by gas to the breather pipe and hence, it is possible to simplify the structure and reduce the number of parts.

The valve-operating cam chamber 21 communicates with the inside of the air cleaner 4 through the breather passage 68, the breather chamber 69 and the breather pipe 70, as described above and hence, the pressure in the valve-operating cam chamber 21 is maintained at or slightly below atmospheric pressure.

On the other hand, the crank chamber 6*a* has a negative pressure state on average by discharging only the positive-pressure component of pressure pulsations through the one-way valve 61. The negative pressure in the crank chamber 6*a* is transmitted to the oil tank 40 via the through-bore 55 and further to the drawing-up chamber 74 through the oil-return conduit 78. Therefore, the pressure in the drawing-up chamber 74 is lower than that in the valve-operating cam chamber 21, and the pressure in the oil tank 40 is lower than that in the drawing-up chamber 74. As a result, the pressure is transferred from the valve-operating cam chamber 21 through the drawing-up pipes 75 and 76 and the orifices 73 into the drawing-up chamber 74 and further downwards through the oil-return conduit 78 into the oil tank 40. Accompanying this transfer, the oil mist within the valve-operating cam chamber 21 and the oil liquefied and retained in the valve-operating cam chamber 21 are drawn up into the drawing-up chamber 74 through the drawing-up pipes 75 and 76 and the orifices 73, and returned to the oil tank 40 through the oil-return conduit 78.

In this case, any of the six orifices 73 is immersed in the oil retained in the valve-operating cam chamber 21 regardless of the operational position of the engine E, such as an upright state (in FIG. 18A), a leftward tilted state (in FIG. 18B), a rightward tilted state (in FIG. 18C), a leftward laid state (in FIG. 18D), a rightward laid state (in FIG. 18E) and a upside down state (in FIG. 18F), as shown in FIGS. 18A to 18F, whereby the oil can be drawn up into the drawing-up chamber 74, because the four orifices 73 are provided at four points of the bottom wall of the drawing-up chamber 74, and the orifices 73 are provided in the two long and short drawing-up pipes 75 and 76 which are arranged at a distance in the direction perpendicular to the axis of the camshaft 26 and protrude from the central portion of the bottom wall into the valve-operating cam chamber 21, as described above.

Thus, the oil misted in the oil tank 40 is supplied to the crank chamber 6*a* and the valve-operating cam chamber 21 of the OHC-type 4-cycle engine E by utilizing the pulsation of pressure in the crank chamber 6*a* and the function of the one-way valve 61, and is returned to the oil tank 40. Therefore, in any operational position of the engine E, the inside of the engine can be reliably lubricated by the oil mist and moreover, a pump exclusively for circulating the oil mist is not required and hence, it is possible to simplify the structure.

Not only the oil tank 40 made of a synthetic resin, but also the oil-feed conduit 60 providing communication between the crank chamber 6*a* and the valve-operating cam chamber 21 and the oil-return conduit 78 providing communication between the drawing-up chamber 74 and the oil tank 40 are disposed outside the engine body 1. Therefore, it is possible to greatly contribute to a reduction in weight of the engine E without obstructing a reduction in thickness and compactness of the engine body 1. Particularly, the oil-feed conduit 60 and the oil-return conduit 78 disposed outside the engine body 1 are difficult to be influenced by the heat from the engine body 1 and hence, it is possible to avoid overheating of the lubricating oil O. In addition, the integral formation of the oil-feed conduit 60 and the oil-return conduit 78 with the belt cover 46 can contribute to a reduction in the number of parts and an enhancement in the assembly performance.

Although the embodiment of the present invention has been described in detail, it will be understood that the present invention is not limited to the above-described embodiment, and various modifications in design may be made without departing from the spirit and scope of the invention defined in claims.

What is claimed is:

1. A seal structure between a cylinder head and a head cover in an engine, said cylinder head having a valve-operating cam chamber defined therein, rocker arms being vertically swingably supported on the cylinder head in said valve-operating cam chamber, said seal structure comprising:

a seal member interposed between said cylinder head and said head cover, said cylinder head having a slanting face portion at least at an intermediate portion of an upper end face of the cylinder head to which face said valve-operating cam chamber opens, said head cover being coupled to the upper end face of said cylinder head by bolts to close said valve-operating cam chamber, wherein the upper end face of said cylinder head comprises a pair of flat face portions parallel to each other at different height levels, wherein said slanting face portion connects said flat face portions to each other and is declined toward positions when said rocker arms are vertically swingably support on the cylinder head, wherein said head cover has a fit wall portion formed thereon and fitted to an inner peripheral surface of said valve-operating cam chamber, and said seal member is mounted in a seal groove provided in an outer peripheral surface of said fit wall portion to come into close contact with an inner peripheral surface of said cylinder head, and wherein said head cover is formed with a flange portion abutting against said upper end face, said flange portion being coupled to said cylinder head at locations corresponding to said flat face portions by said bolts.

* * * * *